US009574273B2

(12) United States Patent
Kim et al.

(10) Patent No.: US 9,574,273 B2
(45) Date of Patent: Feb. 21, 2017

(54) METHOD FOR PREPARING MULTILAYER METAL COMPLEX HAVING EXCELLENT SURFACE PROPERTIES

(71) Applicant: OCI COMPANY LTD., Seoul (KR)

(72) Inventors: Ki-Hoon Kim, Seongnam-si (KR); Sung-Koo Kang, Seongnam-si (KR); Min-Kyung Oh, Seongnam-si (KR); Hyung-Rak Kim, Seongnam-si (KR)

(73) Assignee: OCI COMPANY LTD., Seoul (KR)

( * ) Notice: Subject to any disclaimer, the term of this patent is extended or adjusted under 35 U.S.C. 154(b) by 124 days.

(21) Appl. No.: 14/485,310

(22) Filed: Sep. 12, 2014

(65) Prior Publication Data

US 2015/0079414 A1 Mar. 19, 2015

(30) Foreign Application Priority Data

Sep. 17, 2013 (KR) ..... 10-2013-0112003

(51) Int. Cl.

| | |
|---|---|
| ***C23C 28/02*** | (2006.01) |
| ***C23C 18/44*** | (2006.01) |
| ***C23C 18/16*** | (2006.01) |

(52) U.S. Cl.

CPC ..... *C23C 18/44* (2013.01); *C23C 18/166* (2013.01); *C23C 18/1635* (2013.01); *C23C 18/1651* (2013.01); *C23C 28/023* (2013.01); *Y10T 428/12028* (2015.01)

(58) Field of Classification Search

None

See application file for complete search history.

(56) References Cited

U.S. PATENT DOCUMENTS

| | | | | |
|---|---|---|---|---|
| 4,450,188 | A * | 5/1984 | Kawasumi | B22F 1/025 252/513 |
| 4,944,985 | A * | 7/1990 | Alexander | C23C 18/1635 428/403 |
| 2002/0061363 | A1* | 5/2002 | Halas | B82Y 20/00 427/217 |

FOREIGN PATENT DOCUMENTS

| | | | |
|---|---|---|---|
| CN | 101088670 | A | 12/2007 |
| JP | 02118079 | A | 5/1990 |
| JP | 02153076 | A | 6/1990 |
| JP | 2000248303 | A | 9/2000 |
| KR | 100292944 | B1 | 6/2001 |
| KR | 1020070104802 | A | 10/2007 |

OTHER PUBLICATIONS

Machine translation of CN 101088670, Dec. 2007.*
Translation of CN 101088670, Dec. 2007.*
Japanese Office Action dated Aug. 18, 2015 in connection with the counterpart Japanese Patent Application No. 2014-188539.
Korean Office Action dated Nov. 27, 2014.
Chinese Office Action dated Feb. 1, 2016 in connection with the counterpart Chinese Patent Application No. 201410475137.2.

* cited by examiner

*Primary Examiner* — Erma Cameron
(74) *Attorney, Agent, or Firm* — Hauptman Ham, LLP

(57) ABSTRACT

Disclosed herein is a method for preparing a multilayer metal complex having excellent surface properties. Specifically, the present invention relates to a method for preparing a multilayer metal complex having a low cost metal-core/noble metal-shell structure, which has a high mass fraction of noble metals and exhibits excellent surface properties and dispersity.

10 Claims, 5 Drawing Sheets

METHOD FOR PREPARING MULTILAYER METAL COMPLEX HAVING EXCELLENT SURFACE PROPERTIES

CROSS REFERENCE TO RELATED APPLICATION

This application claims the benefit of Korean Patent Application No. 10-2013-0112003, filed on Sep. 17, 2013, entitled "Method For Preparing Multilayer Metal Complex Having Excellent Surface Properties", which is hereby incorporated by reference in its entirety into this application.

BACKGROUND

1. Technical Field

The present invention relates to a method for preparing a multilayer metal complex having excellent surface properties. More particularly, the present invention relates to a method for preparing a multilayer metal complex having a low cost metal-core/noble metal-shell structure, which has a high mass fraction of noble metals, and exhibits excellent surface properties and dispersity.

2. Description of the Related Art

Metal complexes having a low cost metal-core/noble metal-shell structure capable of being used as low cost conductive pastes and electromagnetic shielding substances are known in the art and exhibit excellent conductivity to provide high reliability when applied to products.

For metal complexes used in such purposes, it is important that noble metals forming a shell structure are uniformly and sufficiently adhered to a surface of a low cost metal, thereby secure a sufficient thickness.

Complexes of a copper core/silver shell structure are widely used in the art. Conventionally, a copper-silver complex is prepared by a liquid phase reduction method. All processes of the liquid phase reduction method are carried out in liquid phase. However, this method has problems in that aggregation can easily occur due to interfacial effects between a solid phase and a liquid phase and an excess of reducing agents, and separation of silver particles also occurs, thereby making it difficult to obtain a complex with a uniform surface. In addition, when a large amount of silver ions is introduced in order to increase silver content, the silver ions are uniformly dispersed on the surface of copper, making it difficult to obtain a thin silver layer, and voids are generated inside the complex due to active melting of copper.

Therefore, there is a need for a method for preparing a novel metal complex through controlled process conditions so as to solve the above problems and provide excellent surface properties.

BRIEF SUMMARY

It is an aspect of the present invention to provide a method for preparing a multilayer metal complex that has improved adhesion between a low cost metal-core and a noble metal-shell through melting inhibition of the low cost metal and exhibits excellent surface properties and dispersity by solving the aforementioned problems.

In accordance with one aspect of the present invention, a method for preparing a multilayer metal complex includes: a) forming a primary coating layer of a second metal on surfaces of particles of a first metal by adding a second mixed solution to a first mixed solution, wherein the first mixed solution is prepared by mixing particles including the first metal with a reducing agent and the second mixed solution is prepared by mixing a precursor including the second metal with a complexing agent; and b) forming a secondary coating layer of the second metal on the surfaces of the particles of the first metal by adding a third mixed solution to a resultant mixture prepared in step a) and including the particles of the first metal having the primary coating layer of the second metal formed on the surfaces thereof, wherein the third mixed solution is prepared by mixing the precursor including the second metal with the complexing agent, whereby the second metal having reduction potential higher than that of the first metal is coated in multiple layers on the surfaces of the particles of the first metal.

With the method according to the present invention, it is possible to prepare a metal complex that has improved adhesion between a first metal-core and a second metal-shell through melting inhibition of the first metal while maintaining high content of the second metal in the complex, and exhibits excellent surface properties and dispersity.

BRIEF DESCRIPTION OF THE DRAWINGS

The above and other aspects, features, and advantages of the present invention will become apparent from the following detailed description of embodiments in conjunction with the accompanying drawings, in which.

DETAILED DESCRIPTION

Figure 1A:
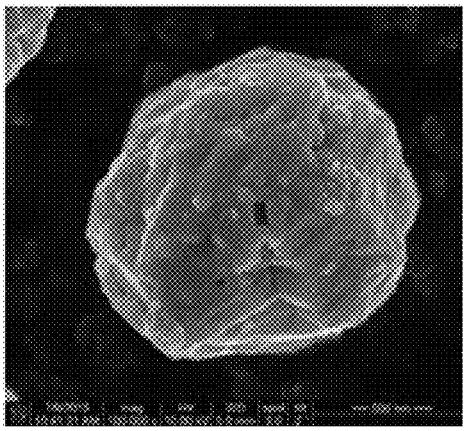
FIG. 1*a* is a high magnification SEM image of a particle of a metal complex prepared in Example 1.

Embodiments of the present invention will now be described in detail with reference to the accompanying drawings. It should be understood that the following embodiments are provided for illustration only and are not to be construed in any way as limiting the present invention, and that various modifications, changes, alterations, and equivalent embodiments can be made by those skilled in the art without departing from the spirit and scope of the invention. Therefore, the scope of the invention should be limited only by the accompanying claims and equivalents thereof.

Hereinafter, a method for preparing a multilayer metal complex according to one embodiment of the present invention will be described.

The method for preparing a multilayer metal complex according to the embodiment of the present invention includes: a) forming a primary coating layer of a second metal on surfaces of particles of a first metal by adding a second mixed solution to a first mixed solution, wherein the first mixed solution is prepared by mixing particles including the first metal with a reducing agent and the second mixed solution is prepared by mixing a precursor including the second metal with a complexing agent; and b) forming to a secondary coating layer of the second metal on the surfaces of the particles of the first metal by adding a third mixed solution to a resultant mixture prepared in step a) and including the particles of the first metal having the primary coating layer of the second metal formed on the surfaces thereof, wherein the third mixed solution is prepared by mixing the precursor including the second metal with the complexing agent, whereby the second metal having reduction potential higher than that of the first metal is coated in multiple layers on the surfaces of the particles of the first metal.

First, in Step a), a second mixed solution prepared by mixing a precursor including a second metal with a complexing agent is added to a first mixed solution prepared by mixing particles including a first metal with a reducing agent to form a primary coating layer comprised of the second metal on surfaces of the particles of the first metal (also referred to as "first metal particles").

Examples of the first metal may include copper, nickel, tin, zinc, gold, platinum, and the like. These may be used alone or in combination thereof. For example, the first metal particles may be copper particles comprised of copper alone, or copper-nickel alloy particles comprised of copper and nickel. The first metal particles may form a core structure in the metal complex of the present invention.

The reducing agent causes reduction of second metal ions residing in the precursor including the second metal, thereby forming a coating layer in which the second metal is coated on the surfaces of the first metal particles. The reducing agent may be at least one selected from ascorbic acid, hydrazine, glucose, hydroxylamine, and citrate. Preferably, ascorbic acid having a rapid reduction rate for the second metal ions is used as the reducing agent.

The second metal is preferably at least one selected from silver, gold and copper. In the metal complex of the invention, the second metal may form the coating layer on the surfaces of the first metal particles, thereby providing a shell structure of the complex.

The complexing agent is preferably at least one selected from EDTA (ethylenediaminetetraacetic acid), EDA (ethylenediamine), thiosulfate, ammonia, cyanide, sulfites, and thiourea. The complexing agent used in the present invention reacts with the second metal ions to form a coordinate bond, thereby suppressing reduction of the second to metal ions by lowering reduction potential of the second metal ions. For example, when ETDA is used as a complexing agent, metal ions and EDTA form a complex as shown in Formula 1, by which reduction of the second metal ions is suppressed.

(1)

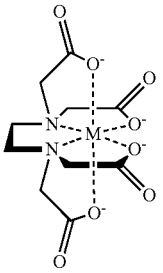

In Step a), the primary coating layer of the second metal is formed on the surfaces of the first metal particles. Namely, in Step a), the primary coating layer of the second metal is uniformly formed on the surface of the first metal particle to prevent the surface of the first metal from being exposed to the outside, such that a coating layer of the second metal can be stably and uniformly formed again through crystal growth of the second metal. To this end, the ratio of molarity of the second metal ions in the precursor to molarity of the complexing agent in the second mixed solution is the same as or different from, preferably different from, the ratio of molarity of the second metal ions in the precursor to molarity of the complexing agent in the third mixed solution.

Specifically, reduction of the second metal ions in Step a) is required to be slowly carried out. Thus, it is desirable that the ratio of molarity of the second metal ions in the precursor to molarity of the complexing agent in the second mixed solution ranges from 1:10 to 1:30. Namely, the concentration of the complexing agent suppressing reduction of the second metal ions is required to fall within this range. When the concentration of the complexing agent is less than this range, the reduction potential of the second metal ions at an initial stage of reaction becomes too high, so that the second metal non-uniformly grows on the surface of the first metal and further grows in a subsequent crystal growth stage to expose the surface of the first metal, thereby causing non-uniform dispersion. When the concentration of the complexing agent is greater than the above range, there are problems in that reduction of the second metal ions is excessively suppressed, thereby failing to properly form a coating layer on the surfaces of the first metal particles.

Next, in Step b), the third mixed solution prepared by mixing the precursor including the second metal with the complexing agent is added to the resultant mixture of Step a) including the first metal particles having the primary coating layer of the second metal formed thereon to form a secondary coating layer of the second metal on the surfaces of the first metal particles, whereby the secondary coating layer is additionally formed on the primary coating layer comprised of the second metal formed in Step a).

In this step, crystal growth of the second metal constituting the primary coating layer formed on the surfaces of the first metal particles occurs. Since crystal growth is carried out using the same kind of metal, that is, the second metal, instead of using different kinds of metal, it is desirable that the reduction potential of the second metal ions is higher than the reduction potential in Step a). The third mixed solution used in this step may have the same as or different ratio of molarity of the second metal ions in the precursor to molarity of the complexing agent from that of the second mixed solution used in the previous step. When the ratio of molarity of the second metal ions in the precursor to molarity of the complexing agent in the third mixed solution is different than that of the second mixed solution, the ratio of molarity of the second metal ions in the precursor to molarity of the complexing agent in the third mixed solution may range from 1:4 to 1:10. If the molarity ratio of the third mixed solution is less than this range, the complexing agent and the second metal can form an insoluble complex. If the molarity ratio of the third mixed solution is greater than this range, the complexing agent can remain, thereby deteriorating reaction efficiency.

In addition, the present invention may further form a coating layer comprised of the second metal by adding a fourth mixed solution, which is prepared by mixing the precursor with the complexing agent, after forming a coating layer on the surfaces of the first metal particles by adding the third mixed solution in Step b). In the same manner as in step b), since crystal growth of the second metal occurs, it is desirable that the reduction potential of the second metal ions is higher than the reduction potential in step a). The fourth mixed solution used in this step may have the same as or different ratio of molarity of the second metal ions in the precursor to molarity of the complexing agent than the mixed solutions used in Steps a) and b). When the ratio of molarity of the second metal ions in the precursor to molarity of the complexing agent in the fourth mixed solution is different from the ratio of molarity of the second metal ions in the precursor to molarity of the complexing agent in the second or third mixed solution, the ratio of molarity of the second metal ions in the precursor to molarity of the complexing agent in the fourth mixed solution may range from 1:4 to 1:10. If the molarity ratio of the fourth mixed solution is less than this range, the complexing agent and the second metal can form an insoluble complex. If the molarity ratio of the fourth mixed solution is greater than this range, the complexing agent can remain, thereby deteriorating reaction efficiency.

In the above description, the method for preparing a multilayer metal complex employs the third mixed solution and fourth mixed solution for crystal growth. However, it should be understood that the same procedure may be additionally performed within the scope of the present invention.

According to the present invention, the first mixed solution may further include a compound having at least two carboxylic functional groups as an auxiliary agent. The auxiliary agent may include oxalic acid, malonic acid, succinic acid, glutaric acid, adipic acid, pimelic acid, suberic acid, azelaic acid, sebacic acid, citric acid, isocitric acid, aconitic acid, propane-1,2,3-tricarboxylic acid, trimesic acid, maleic acid, tartaric acid, and the like. Specifically, tartaric acid may be used as an auxiliary agent in terms of excellent surface properties.

The present invention will be described in more detail with reference to some examples and comparative examples.

EXAMPLE 1

(1) Preparation of First Mixed Solution

To distilled water in a reactor, 2 liter of a mixed solution consisting of 11 g of $(NH_4)_2SO_4$ and 4 ml of $NH_4OH$ was added, followed by adding 21 g of copper powder and reaction for 5 minutes through vigorous stirring. After centrifugation, the solution was removed from the mixture, and distilled water was added to the mixture, which in turn was subjected to centrifugation three times. Then, the obtained copper particles were dispersed in 525 ml of water, followed by adding 10.12 g of ascorbic acid and 4.25 g of tartaric acid.

(2) Preparation of Second Mixed Solution

To a solution prepared by mixing 80.84 g of EDTA and 30.92 g of NaOH with 525 ml of water, 3.68 g of silver nitrate was added to prepare a second mixed solution for use in primary addition.

(3) Preparation of Third Mixed Solution

To a solution prepared by mixing 80.97 g of EDTA and 41.54 g of NaOH with 525 ml of water, 8.35 g of silver nitrate was added to prepare a third mixed solution for use in secondary addition.

(4) Preparation of Fourth Mixed Solution

To a solution prepared by mixing 60.19 g of EDTA and 30.36 g of NaOH with 525 ml of water, 6.78 g of silver nitrate was added to prepare a fourth mixed solution for use in tertiary addition.

(5) Formation of Coating Layer (Primary)

To the first mixed solution, 525 ml of the second mixed solution to be used in primary addition was added at a rate of 600 ml/hour at 500 rpm to form a primary silver coating layer on the surfaces of the copper particles. In the addition, a liquid injection device was employed and reaction was continued for 5 minutes after finishing injection.

(6) Formation of Coating Layer (Secondary, Thirdly) and Complexing

To a solution including the copper particles having the primary coating layer formed on the surface, 10.12 g of ascorbic acid and 4.25 g of tartaric acid were added, followed by adding 525 ml of the third mixed solution at a rate of 600 ml/hour at 500 rpm to grow silver crystals. The third mixed solution was injected for 90 minutes using a liquid injection device, and reaction was continued for 5 minutes after finishing injection.

To a solution including the copper particles subjected to a secondary silver crystal growth, 10.12 g of ascorbic acid and 4.25 g of ascorbic acid were added, followed by adding 525 ml of the fourth mixed solution at a rate of 600 ml/hour at 500 rpm to further grow the silver crystals. The fourth mixed solution was injected for 90 minutes using a liquid injection device.

After completing reduction, the reaction products were subjected to centrifugation at 3000 rpm. After decanting the solution, distilled water was added and centrifugation was repeated three times. Subsequently, particle washing and drying were carried out to obtain a metal complex having a copper core/silver shell structure wherein silver coating layers are formed in multiple layers.

EXAMPLE 2

A metal complex having a copper core/silver shell structure was obtained in the same manner as in Example 1 using a third mixed solution and a fourth mixed solution, wherein the third mixed solution was prepared by adding 8.35 g of silver nitrate to a solution prepared by mixing 90.58 g of EDTA and 38.2 g of NaOH with 525 ml of water, and the fourth mixed solution was prepared by adding 6.78 g of silver nitrate to a solution prepared by mixing 70.19 g of EDTA and 35.36 g of NaOH with 525 ml of water.

EXAMPLE 3

A metal complex having a copper core/silver shell structure was obtained in the same manner as in Example 1 using a third mixed solution and a fourth mixed solution, wherein the third mixed solution was prepared by adding 8.35 g of silver nitrate to a solution prepared by mixing 65.59 g of EDTA and 33.24 g of NaOH with 525 ml of water, and the fourth mixed solution was prepared by adding 6.78 g of silver nitrate to a solution prepared by mixing 42.34 g of EDTA and 21.18 g of NaOH with 525 ml of water.

EXAMPLE 4

A metal complex having a copper core/silver shell structure was obtained in the same manner as in Example 1 using a second mixed solution prepared by adding 3.68 g of silver nitrate to a solution prepared by mixing 90.54 g of EDTA and 40.17 g of NaOH with 525 ml of water.

EXAMPLE 5

A metal complex having a copper core/silver shell structure was obtained in the same manner as in Example 1 using a second mixed solution prepared by adding 3.68 g of silver nitrate to a solution prepared by mixing 60.75 g of EDTA and 25.58 g of NaOH with 525 ml of water.

EXAMPLE 6

A metal complex having a copper core/silver shell structure was obtained in the same manner as in Example 1 except that hydroxylamine was used as a reducing agent instead of ascorbic acid.

EXAMPLE 7

A metal complex having a copper core/silver shell structure was obtained in the same manner as in Example 1 except that ammonia was used as a complexing agent instead of EDTA.

EXAMPLE 8

A metal complex having a copper core/silver shell structure was obtained in the same manner as in Example 1 except that glutaric acid was used as an auxiliary agent instead of tartaric acid.

COMPARATIVE EXAMPLE 1

(1) Preparation of First Mixed Solution

To distilled water in a reactor, 2 liter of a mixed solution consisting of 11 g of $(NH_4)_2SO_4$ and 4 ml of $NH_4OH$ was added, followed by adding 21 g of copper powder and reaction for 5 minutes through vigorous stirring. After centrifugation, the solution was removed from the mixture, and distilled water was added to the mixture, which in turn was subjected to centrifugation three times. Then, the obtained copper particles were dispersed in 525 ml of water, followed by adding 4.2 g of ascorbic acid and 28 g of tartaric acid.

(2) Preparation of Second Mixed Solution

To a solution prepared by mixing 180.25 g of EDTA and 90.58 g of NaOH with 525 ml of water, 17.87 g of silver nitrate was added to prepare a second mixed solution.

(3) Preparation of Metal Complex

To the first mixed solution, 525 ml of the second mixed solution was added at a rate of 600 ml/hour at 500 rpm to form a primary silver coating layer on the surfaces of the copper particles. The second mixed solution was injected for 90 minutes using a liquid injection device.

After completing reduction, the reaction products were subjected to centrifugation at 3000 rpm. After decanting the solution, distilled water was added and centrifugation was repeated three times. Subsequently, particle washing and drying were carried out to obtain a metal complex having a copper core/silver shell structure in which silver coating layers are formed in multiple layers.

COMPARATIVE EXAMPLE 2

A metal complex having a copper core/silver shell structure was obtained in the same manner as in Example 1 using a second mixed solution prepared by adding 3.68 g of silver nitrate to a solution prepared by mixing 190.26 g of EDTA and 85.12 g of NaOH with 525 ml of water.

COMPARATIVE EXAMPLE 3

A metal complex having a copper core/silver shell structure was obtained in the same manner as in Example 1 using a second mixed solution prepared by adding 3.68 g of silver nitrate to a solution prepared by mixing 20.45 g of EDTA and 10.58 g of NaOH with 525 ml of water.

COMPARATIVE EXAMPLE 4

A metal complex having a copper core/silver shell structure was obtained in the same manner as in Example 1 using a third mixed solution prepared by adding 8.35 g of silver nitrate to a solution prepared by mixing 160.74 g of EDTA and 80.84 g of NaOH with 525 ml of water.

COMPARATIVE EXAMPLE 5

A metal complex having a copper core/silver shell structure was obtained in the same manner as in Example 1 using a third mixed solution prepared by adding 6.78 g of silver nitrate to a solution prepared by mixing 31.25 g of EDTA and 16.28 g of NaOH with 525 ml of water.

COMPARATIVE EXAMPLE 6

A metal complex having a copper core/silver shell structure was obtained in the same manner as in Example 1 except that tartaric acid was not used as an auxiliary agent.

Evaluation

1. SEM Analysis

Figure 1B:
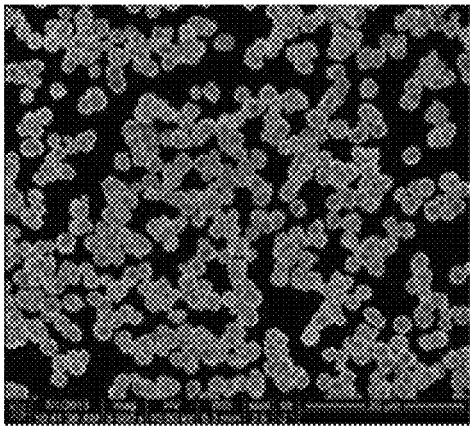
FIG. 1*b* is a low magnification SEM image of multiple particles of the metal complex prepared in Example 1.
Figure 1C:
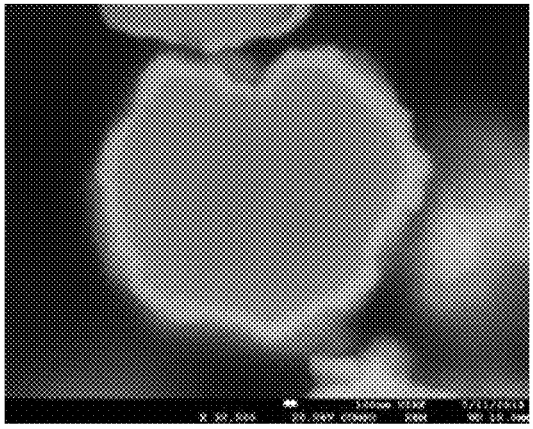
FIG. 1*c* is a cross-sectional SEM image of the metal complex prepared in Example 1.

The metal complex prepared by Example 1 was observed through electronic microscopy and results as shown in FIGS. 1*a*, 1*b* and 1*c* were obtained.

FIG. 1*a* is a high magnification SEM image of a particle of the metal complex prepared in Example 1; FIG. 1*b* is a low magnification SEM image of multiple particles of the metal complex prepared in Example 1; and FIG. 1*c* is a cross-sectional SEM image of the metal complex prepared in Example 1.

In FIGS. 1*a*, 1*b* and 1*c*, it was confirmed that silver was uniformly and densely adhered to the surface of copper, thereby providing excellent surface properties.

2. ICP Analysis (1) Analysis at Each Step

With respect to the metal complex prepared in Example 1, ICP analysis was performed in order to confirm morphology of silver coating layers formed at each step. Results are shown in FIG. 2 and the compositions of copper and silver are shown in Table 1.

TABLE 1

| | Copper (wt %) | Silver (wt %) |
|---|---|---|
| Addition of second mixed solution | 88.59 | 11.41 |
| Addition of third mixed solution | 70.73 | 29.27 |
| Addition of fourth mixed solution | 55.10 | 44.9 |

Figure 2:
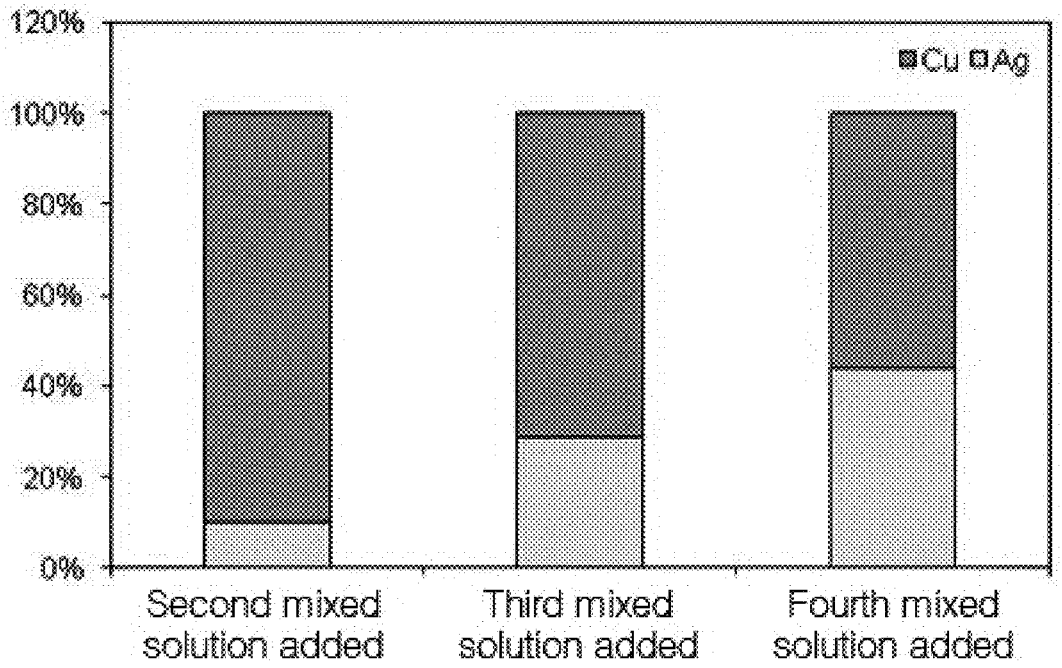
FIG. 2 shows ICP analysis results of the metal complex prepared in Example 1 at each step (steps of forming coating layers by adding a second mixed solution, a third mixed solution, and a fourth mixed solution, in which a precursor including a second metal is mixed with a complexing agent)

In FIG. 2 and Table 1, it could be seen that coating layers were formed by the method according to the present invention in which silver was evenly and uniformly dispersed on the surface of copper by varying the concentrations of EDTA (complexing agent) and silver ions (second metal ion) forming a shell at each step.

(2) Analysis of Repeatability

Figure 3:
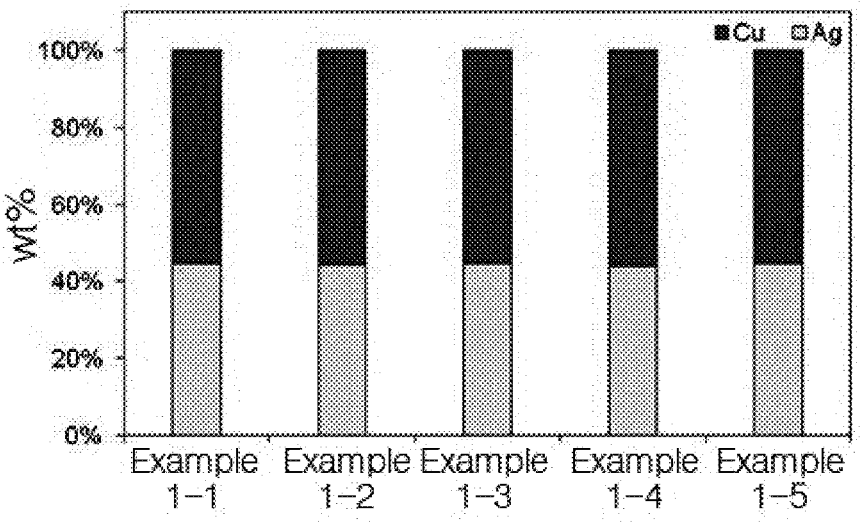
FIG. 3 shows ICP analysis results of metal complexes repeatedly prepared five times in Example 1.

The preparation method in Example 1 was repeated five times (Examples 1-1 to 1-5), and the prepared metal complexes were subjected to ICP analysis. Results are shown in FIG. 3. As can be seen from FIG. 3, the preparation method of the present invention showed excellent repeatability.

3. Evaluation of Physical Properties

The metal complexes prepared in Examples and Comparative Examples was evaluated as to surface properties, conductivity, and the like. Results are shown in Table 2.

TABLE 2

| | Content of second metal (silver) (wt %) | Surface properties (Good, Poor, Normal) | Specific resistance* (μΩ · cm) |
|---|---|---|---|
| Example 1 | 42 | Good | 55 |
| Example 2 | 41 | Good | 68 |
| Example 3 | 42 | Normal | 152 |
| Example 4 | 41 | Good | 71 |
| Example 5 | 42 | Normal | 178 |
| Example 6 | 42 | Normal | 259 |
| Example 7 | 42 | Normal | 221 |
| Example 8 | 42 | Normal | 189 |
| Comparative Example 1 | 42 | Poor | 598 |
| Comparative Example 2 | 42 | Poor | 501 |
| Comparative Example 3 | 42 | Poor | 733 |
| Comparative Example 4 | 42 | Poor | 538 |
| Comparative Example 5 | 42 | Poor | 645 |
| Comparative Example 6 | 42 | Poor | 445 |

*Specific resistance was measured using sintered products obtained by preparing pastes including mixtures prepared by mixing silver nanoparticles with the metal complexes prepared in Examples and Comparative Examples, screen printing the pastes in a rectangular shape of 2 × 3 $cm^2$ on a silicon substrate, drying the resultant material at 160° C. and then sintering the resultant material by heating to 700° C. for 30 seconds and maintaining for 10 seconds.

In Table 2, it can be seen that the preparation method of the present invention can provide a metal complex having high content of silver while exhibiting excellent surface properties and excellent conductivity.

Although some embodiments have been described herein, it should be understood that various modifications, changes, alterations, and equivalent embodiments can be made by those skilled in the art without departing from the spirit and scope of the invention. Therefore, the scope of the invention should be limited only by the accompanying claims and equivalents thereof.

What is claimed is:

1. A method for preparing a multilayer metal complex, comprising:

preparing a first mixed solution by mixing particles of a first metal with a reducing agent;

preparing a second mixed solution by mixing a precursor comprising second metal ions with a complexing agent;

forming a primary coating layer of a second metal on surfaces of particles of the first metal by preparing a resultant mixture by adding the second mixed solution to the first mixed solution;

preparing a third mixed solution by mixing the precursor comprising the second metal ions with the complexing agent;

forming a secondary coating layer of the second metal on the primary coating layer by adding the third mixed solution to the resultant mixture, wherein a reduction potential of the second metal is higher than a reduction potential of the first metal, wherein a ratio of molarity of the second metal ions in the precursor to molarity of the complexing agent in the second mixed solution is different than a ratio of molarity of the second metal ions in the precursor to molarity of the complexing agent in the third mixed solution, wherein the ratio of molarity of the second metal ions in the precursor to molarity of the complexing agent in the second mixed solution ranges from 1:10 to 1:30, and wherein the ratio of molarity of second metal ions in the precursor to molarity of the complexing agent in the third mixed solution ranges from 1:4 to 1:10.

2. The method for preparing a multilayer metal complex according to claim 1, further comprising:

preparing a fourth mixed solution by mixing the precursor comprising the second metal ions with the complexing agent; and forming a tertiary coating layer of the second metal on the secondary coating layer by adding the fourth mixed solution to the resultant mixture.

3. The method for preparing a multilayer metal complex according to claim 2, wherein the second mixed solution, the third mixed solution and the fourth mixed solution have different ratios of molarity of second metal ions in the precursor to molarity of the complexing agent.

4. The method for preparing a multilayer metal complex according to claim 3, wherein a ratio of molarity of second metal ions in the precursor to molarity of the complexing agent in the fourth mixed solution ranges from 1:4 to 1:10.

5. The method for preparing a multilayer metal complex according to claim 1, wherein the first metal comprises at least one selected from copper, nickel, tin, zinc, gold, platinum, and alloys thereof.

6. The method for preparing a multilayer metal complex according to claim 1, wherein the reducing agent comprises at least one selected from ascorbic acid, hydrazine, glucose, hydroxylamine, and citrate.

7. The method for preparing a multilayer metal complex according to claim 1, wherein the second metal comprises at least one selected from silver, gold and copper.

8. The method for preparing a multilayer metal complex according to claim 1, wherein the complexing agent comprises at least one selected from ethylenediaminetetraacetic acid (EDTA), ethylenediamine (EDA), thiosulfate, ammonia, cyanide, sulfites, and thiourea.

9. The method for preparing a multilayer metal complex according to claim 1, wherein the first mixed solution further comprises a compound having at least two carboxylic functional groups as an auxiliary agent.

10. The method for preparing a multilayer metal complex according to claim 9, wherein the auxiliary agent comprises at least one selected from oxalic acid, malonic acid, succinic acid, glutaric acid, adipic acid, pimelic acid, suberic acid, azelaic acid, sebacic acid, citric acid, isocitric acid, aconitic acid, propane-1,2,3-tricarboxylic acid, trimesic acid, maleic acid, and tartaric acid.

* * * * *